United States Patent [19]

Bachler

[11] Patent Number: 4,550,299

[45] Date of Patent: Oct. 29, 1985

[54] ELECTRIC SWITCH WITH PROTECTIVE FUNCTION

[75] Inventor: Sven Bachler, Västerås, Sweden

[73] Assignee: ASEA Aktiebolag, Västerås, Sweden

[21] Appl. No.: 627,668

[22] Filed: Jul. 3, 1984

[30] Foreign Application Priority Data

Jul. 4, 1983 [SE] Sweden ..... 8303808

[51] Int. Cl.[4] ..... H01H 77/10

[52] U.S. Cl. ..... 335/195; 335/16; 335/147

[58] Field of Search ..... 335/16, 147, 195

[56] References Cited

U.S. PATENT DOCUMENTS 3,005,073 10/1961 Reiss et al. ..... 335/195
3,345,485 10/1967 Engel ..... 335/16
3,550,049 12/1970 Blanc-Tailleur ..... 335/195

FOREIGN PATENT DOCUMENTS 2443771 10/1979 Fed. Rep. of Germany .
348592 1/1968 Sweden .

*Primary Examiner*—Harold Broome
*Attorney, Agent, or Firm*—Watson, Cole, Grindle & Watson

[57] ABSTRACT

A current-limiting electric switch for low-voltage has a contact device with a contact finger and an elongated fixed contact arranged side by side. The contact finger is rotatably arranged and forms at one end a break together with the fixed contact and is at the other end provided with a flexible current connection conductor. The contact finger has its bearing point located between the two ends of a movable arm. Through the influence of electrodynamic forces from short-circuit currents, the contact finger is first rotated in one direction of rotation while maintaining the galvanic contact at the break, whereby the movable arm is displaced so that the distance between the bearing point of the contact finger and the fixed contact is increased. A stop means limits the movement of the contact finger in the first direction of rotation and brings about a continuation of the rotational movement in the opposite direction of rotation resulting in an instantaneous contact opening.

11 Claims, 19 Drawing Figures

ELECTRIC SWITCH WITH PROTECTIVE FUNCTION

BACKGROUND OF THE INVENTION

1. Field of the Invention

The present invention relates to an electric switch which is intended to serve as a contactor as well as a protective device in case of short-circuit and overload.

2. Prior Art

It is previously known to provide a current-limiting circuit breaker for low voltage with a bridge contact arranged between two fixed contacts and connected to the circuit-breaker mechanism, on which bridge contact two contact elements, which can be opened through the influence of the dynamic forces of short-circuit currents, are rotatably journalled (German Pat. No. 2,443,771). Such a design functions less well at medium-high breaking currents, where the electrodynamic forces are barely sufficient for the rotatable contact elements to lift. This results in a slow and hesitating contact opening, which may cause considerable contact wear and possibly contact welding.

SUMMARY OF THE INVENTION

The object of the present invention is to provide an electric switch, designed for the above-mentioned field of application, which operates satisfactorily in the entire current range from the lowest operating currents to the highest short-circuit currents occurring in low-voltage networks.

One advantage with this design is that the movable contact, because of its special two-way rotational movement, is charged with kinetic energy before the galvanic contact has been broken. In that way a high speed at the opening moment may be achieved also at moderate currents.

Another advantage is that the point of contact, because of the rolling contact movement, is moved outwardly so that the arc ignites nearer the contact tip, whereby the contact surfaces for operating current are protected.

The invention will be described in greater detail with reference to the accompanying drawing, which shows three embodiments of the contact device for an electric switch constructed according to the invention.

DESCRIPTION OF PREFERRED EMBODIMENTS

Figure 1A:
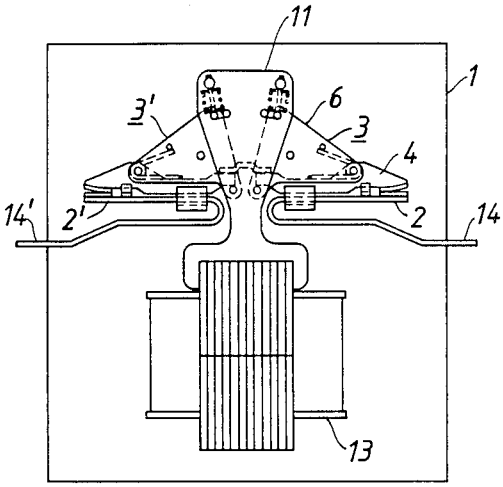
FIGS. 1*a* and 1*b* show schematically a side view of an electric switch with a first embodiment of a contact device according to the invention in the closed and open position, respectively.

The apparatus constructions shown in the drawings are intended for a rating of up to about 1000 A and 1000 V. They may be built up on a stand of, for example, pressure-cast light metal or be provided with a supporting and surrounding housing of insulating material, manufactured by casting, which constitutes an integral part of the respective device.

The electric switch shown in FIGS. 1–5 has a contact device with two electrically series-connected breaks per pole. The contact device comprises, in each pole, two counter contacts 2, 2' fixedly arranged in spaced relationship to each other in an apparatus housing 1, as well as a movable bridge contact device, arranged for cooperation with the contacts, having two series-connected contact units 3, 3'. Each such contact unit comprises a movable contact finger 4 which at one bearing point 5 (FIG. 2) is rotatably fixed to an arm 6 and which at one end supports a contact metal plate 4*a*, which constitutes a contact surface cooperating with the fixed counter contact 2, and which at its other end is provided with a flexible conductor 7, which constitutes the electric connection with the contact finger in the second contact unit 3'. A spring 8 rotates the contact finger 4 towards a stop 9 in the arm 6.

The arm 6, which supports the contact finger 4, is in its turn rotatably attached to a contact carrier 11 at a bearing point 10. A spring mechanism 12 influences the arm with a torsional moment which changes direction at an intermediate position of the arm. From the intermediate position the spring mechanism moves the arm towards one of the end positions.

The contact carrier 11 is common to the two contact units in one pole as well as to all the poles in, for example, a 3-pole or 4-pole apparatus. The contact carrier 11 is operated by a magnet 13 with a return spring, as is common with contactors.

The fixed contact 2 is provided with a contact metal plate 2*a*. The current path is geometrically formed so as to influence the arc in the intended direction. The backwardly-extending part 2*b* of the fixed current path is extended to provide a power of repulsion on the movable contact finger at high currents. The fixed contacts 2, 2' are each connected to a terminal bar 14, 14' for connecting the apparatus into an outer main circuit.

A U-shaped soft iron magnet 15 is placed below the movable contact finger in such a way that part of the cross-section of the contact finger extends between the two legs of the magnet. The yoke of the magnet lies between the movable and the fixed current path. The magnet is fixedly connected to the apparatus housing 1 or to the contact carrier 11. The object of the magnet is to increase the contact pressure at moderate overload currents, and it is positioned in the vicinity of the contact opening point. The magnet shall be dimensioned so as to become saturated at a certain current value so as not unnecessarily to prevent contact opening upon a short-circuit.

A second similarly U-shaped soft iron magnet 16 has its yoke positioned below the backwardly-extending part 2*b* of the fixed current path, and has its legs running on one side each of the movable contact finger. The magnet is fixedly connected to the apparatus housing and is placed at such a distance from the contact opening point as is permitted by the fixed current path. The task of the magnet is to repel the rear portion of the contact finger through its magnetic field at high currents.

Figure 1B:
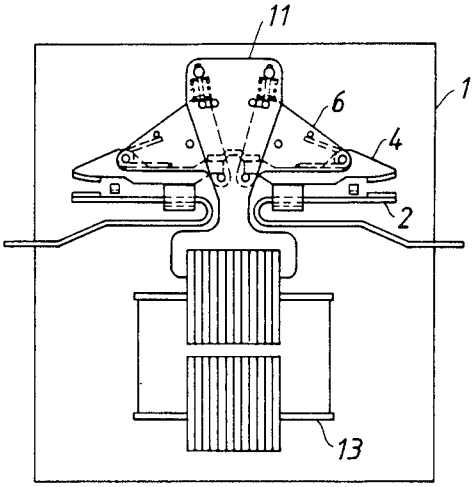
Figure 2:
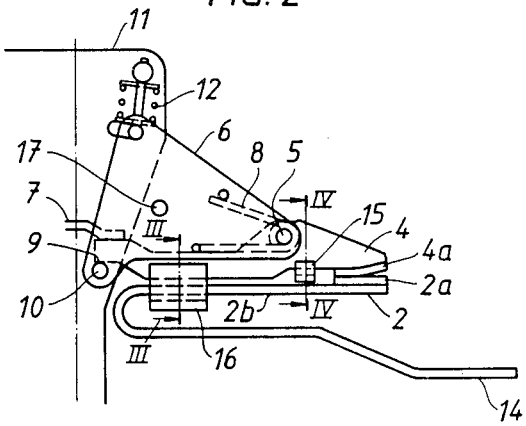
FIG. 2 shows on an enlarged scale parts of the contact device in the closed position.
Figure 3:
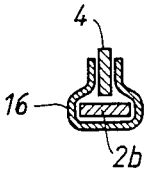
FIGS. 3 and 4 show sections along the lines III—III and IV—IV, respectively, in FIG. 2, FIGS. 5*a*–5*d* show the contact device according to FIG. 2 in different stages during a short-circuit breaking.
Figure 4:
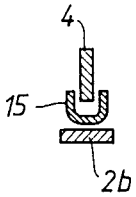

The mode of operation of the device according to FIGS. 1–5 is as follows:

For all current intensities up to a value which can be regarded as normal overload, for example 15 times the rated current, the device operates as a contactor, which is illustrated in FIGS. 1*a* and 1*b*. The arm 6 with the contact finger 4 is then in its lower stable position, and the whole contact carrier moves towards, and from, the contact position, respectively. To obtain a resilient contact abutment, part of the rotating movement of the arm 6 is utilized.

Figure 5A:
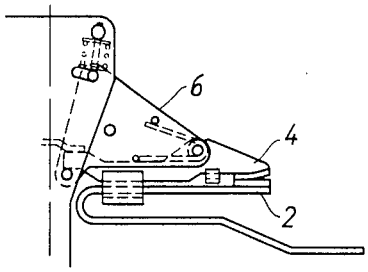
Figure 5B:
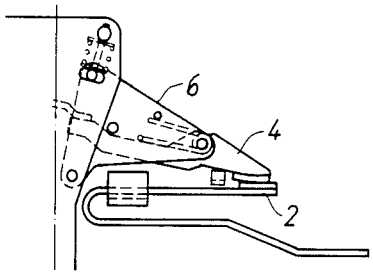
Figure 5C:
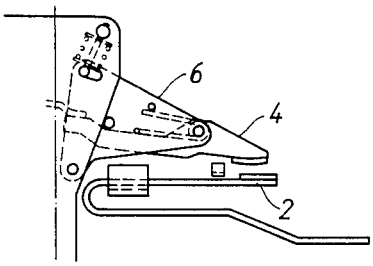
Figure 5D:
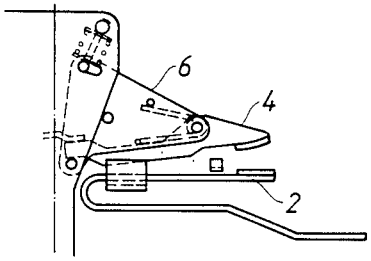
Figure 8:
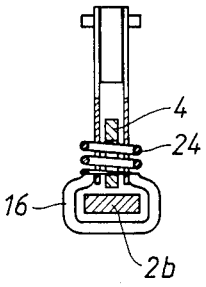
FIGS. 8 and 9 show sections along the lines VIII—VIII and IX—IX, respectively, in FIG. 6*a*.
Figure 9:
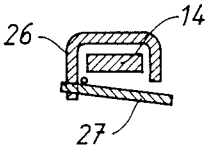
Figure 6A:
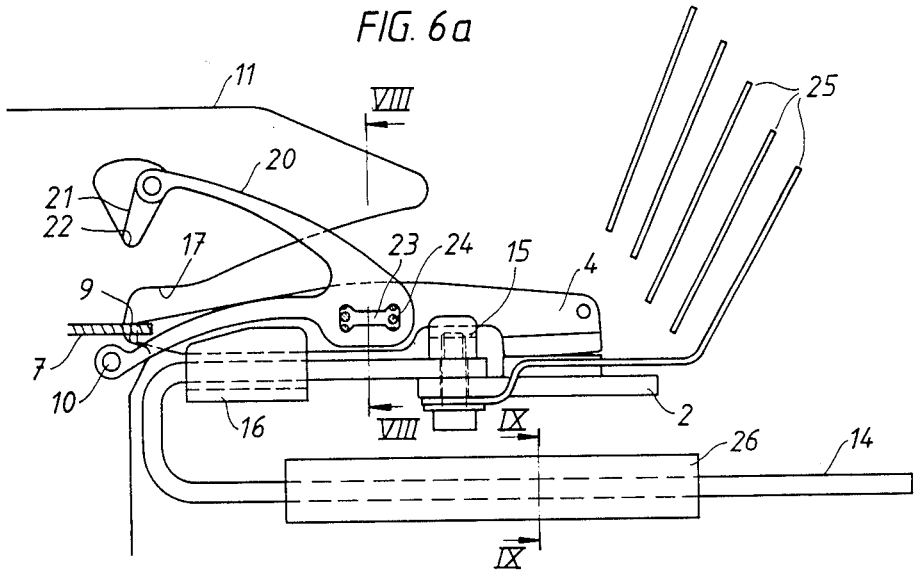
FIGS. 6*a* and 6*b* show schematically a side view of a second embodiment of a contact device according to the invention in the closed position and after a short-circuit breaking, respectively.
Figure 6B:
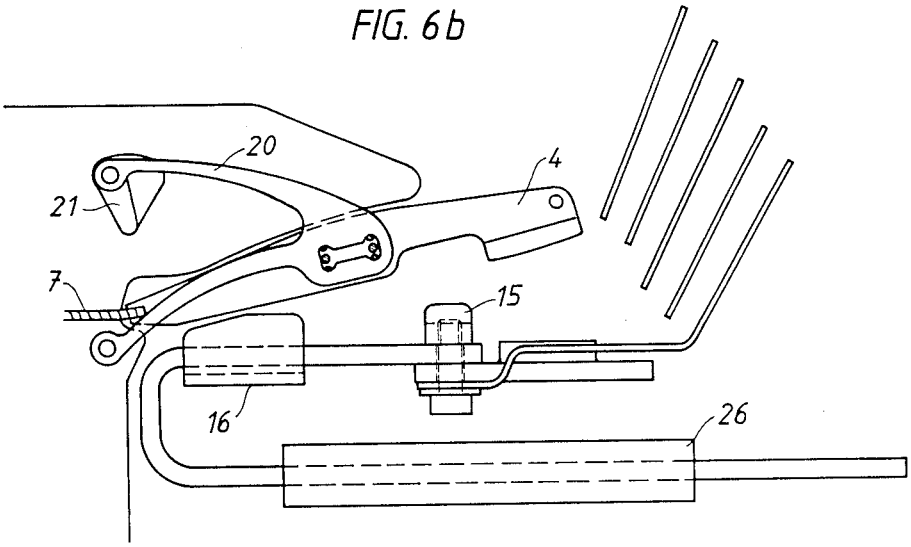
Figure 7:
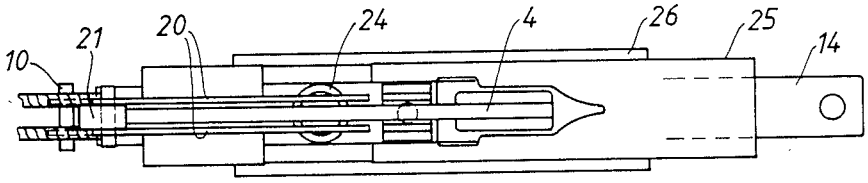
FIG. 7 shows this contact device in a plane view.
Figure 10:
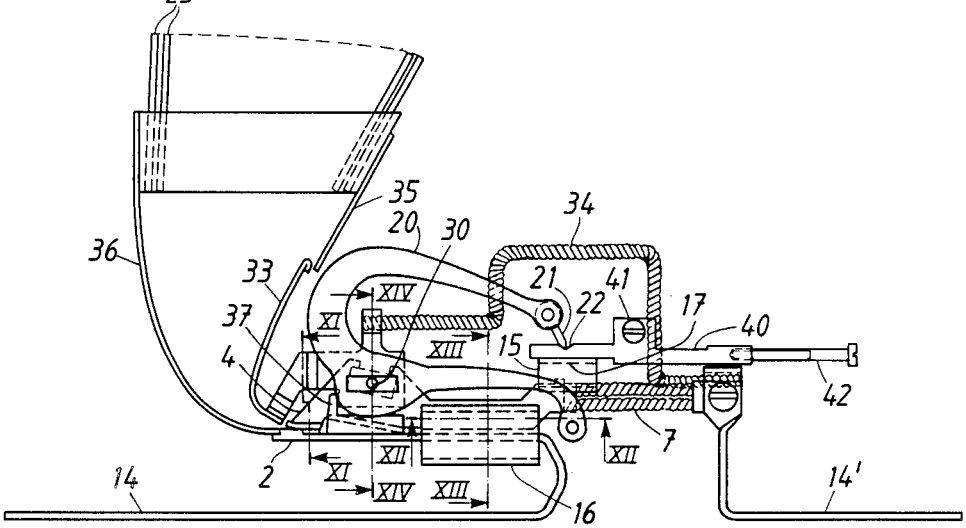
FIG. 10 shows schematically a side view of a third embodiment of a contact device according to the invention in the closed position.
Figure 11:
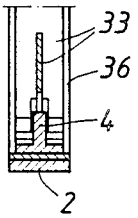
FIGS. 11–14 show sections along the lines XI—XI, XII—XII, XIII—XIII and XIV—XIV, respectively, in FIG. 10.

Breaking of high currents is illustrated in FIGS. 5*a*–5*d*. During the actual breaking operation, the contact carrier 11 maintains its closed position. The cooperating forces from the magnets 15 and 16 result in a torque on the contact finger 4 which, while maintaining a galvanic contact, rotates in a clockwise direction (FIG. 5*b*). Through the rotation, the contact point will move outwards because of the convex contact surface of the finger. The upward movement of the finger will force the arm 6 into an anticlockwise rotation and the arm approaches its dead point. When the arm has passed the dead point, the torque from the spring mechanism 12 changes sign and the whole arm is rotated with the aid of the spring mechanism to its second rest position. By means of a stop bolt 17 in the arm 6, the clockwise rotating movement of the contact finger 4 is restricted. When the contact finger rams into this stop means, the finger will change its direction of rotation, resulting in an instantaneous contact opening (FIG. 5*c*). When the arm 6 has reached its upper rest position and the contact finger 4 with the aid of the spring 8 has returned to its rest position in the arm, the contact is fully open (FIG. 5*d*). The contact opening has been brought about without the contact carrier 11 having had to move. When the contact carrier opens, by the contactor magnet 13 being released, the length of break is further increased, until the arm 6 rams into a stop in the apparatus housing. This stop serves to restore the arm 6 to its original position after a high-current release.

As long as the contact finger 4 is in its initial position, the attraction magnet 15 reaches so high up that an additional holding down force on the contact finger is obtained. When the contact finger is rotated in a clockwise direction, the current path is lifted out of the gap between the magnet legs and the holding down force is reduced.

For high currents, the force from the magnet 15 will have a relatively smaller importance in relation to the repelling forces due to the saturation condition in the magnet. The movement will then be a counter-clockwise rotation for both the arm 6 and the finger 4, and the contact moves from the position according to FIG. 5*a* direct to the position according to FIG. 5*d*.

In the embodiment of the contact device which is shown in FIGS. 6–9, the arm 6 and the spring mechanism 12 of the above-described embodiment have been replaced by two parallel, substantially U-shaped plane springs 20 cut from sheet, which are so arranged that the resilience takes place in the planes of the sheets. One leg end of the springs 20 is rotatably journalled at the bearing point 10 in the contact carrier 11, whereas the other leg end is articulately connected to a supporting leg 21, which, under pressure from the springs 20, is rotatable between two end positions in a bearing 22 arranged in the contact carrier 11.

The contact finger 4 is fixed to the plane springs 20 with the aid of a helical spring 24 arranged in oppositely positioned holes 23 in the springs and in the contact finger. This spring 24 is so arranged that it exerts upon the contact finger a torque which during normal operation holds the contact finger pressed against a stop means 9 arranged on the contact carrier 11. Thus, this helical spring 24 replaces both the bearing 5 and the spring 8 in the device according to FIGS. 1–5. The stop means 9 and 17 of the contact finger, in the embodiment according to FIGS. 6–9, consist of edge surfaces on the contact carrier 11.

The contact device is surrounded by an arc chute with arc extinction plates 25. Further, the device is provided with an instantaneous tripping device 26, arranged around the fixed current path of the device, in the form of a soft iron magnet which surrounds the current path and the armature 27 of which upon a short-circuit current influences a contact device which breaks the current to the contactor magnet.

The embodiment shown in FIGS. 6–9 includes fewer parts and is less expensive in manufacture than the embodiment according to FIGS. 1–5. In addition, it has the advantage that the mass of the movable contact device is considerably lower, which makes possible faster switching operations and lower mechanical stresses on the device.

In the contact device shown in FIGS. 10–14, the contact finger 4 is journalled in the plane springs 20 with the aid of a rigid bearing pin 30 of non-magnetic material surrounded by a spacer 31 of plastic. In this embodiment the magnet 15 is positioned at the root end of the contact finger and with the yoke on the upper side of the contact finger.

Figure 12:
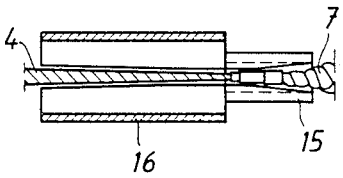
Figure 13:
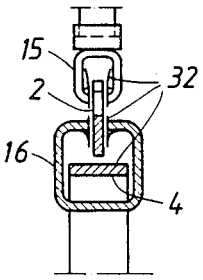
Figure 14:
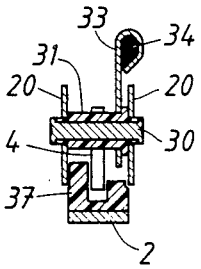

As will be clear from FIG. 12, the air gap of the magnet 16 is tapering in a direction towards the root end of the contact finger 4. In this way the advantage is obtained that the repelling force exerted by the magnet on the contact finger occurs at the correct location at the correct time. At the locations marked 32 in FIG. 13, between the magnets 15, 16 and the contacts 2, 4, electrical insulation is applied.

On the bearing pin 30 an arcing horn 33 is mounted, which via a flexible conductor 34 is connected to one terminal bar 14' of the contact device. The arcing horn 33 is arranged in such a way that its free end slides along a fixed bar 35, which is connected to one end of the assembly of arc extinction plates 25. The other end of the assembly of arc extinction plates communicates, via an arcing horn 36, with the fixed contact 2. Upon a breaking operation the arc will rapidly climb up the arcing horns 33, 36 and be conducted into the assembly of arc extinction plates 25. In this way the wear on the contacts 2, 4 is reduced.

A U-shaped piece of plastic 37 is arranged behind the contact unit to prevent the arc from travelling backwards. This piece of plastic is suitably made of a material which, during heating, emits arc extinguishing gas.

The bearing point 22 for the supporting legs 21 of the springs 20 is arranged on a bar 40 which is fixed to the circuit-breaker body by means of a screw 41. The screw passes through an oblong hole in the bar, whereby the correct contact pressure can be set by means of an adjusting screw 42.

The contact device according to FIGS. 10–14 can be used in a contactor with two series-connected contact units, in the same way as the embodiment according to FIGS. 6–9. The plane springs 20 with their bearings 10 and 22 are then mounted on a contact carrier connected to the contactor magnet.

The circuit-breaker according to FIGS. 10–14 can be modified by omitting the movable arcing horn 33 while at the same time extending the bar 35 and connecting it to the terminal bar 14' by way of a rigid conductor. Such an embodiment will be simpler and, in addition, the mass of the movable contact system will be smaller.

The invention is not limited to the embodiments shown, but several modifications are feasible within the scope of the claims. For example, the invention can also be employed with a construction in which a rigid bridge contact assembly is connected to the operating mechanism, the bridge contact assembly cooperating with two contact units of, for example, the embodiment shown in FIG. 2, which are arranged in spaced relationship to each other and are permanently connected to individual terminal bars.

I claim:

1. A current-limiting electric switch which comprises an elongated, fixed counter contact having a first contact plate, a movable arm, an elongated movable contact having a first end mounting a second contact plate and a second end, said elongated movable contact being rotatably journalled at a bearing point along its length on said movable arm so as to be movable toward and away from said elongated, fixed counter contact, said second contact plate being abuttable against said first contact plate and forming a breaking unit therewith, a flexible current connection conductor attached to the second end of said elongated movable contact, and a first stop means for limiting the rotational movement of said elongated movable contact, the electric switch operating such that, under the influence of electrodynamic forces during a short-circuit interruption, said elongated movable contact, whose second contact plate is in abutting contact with the first contact plate of said elongated counter contact, will first rotate in one direction, its second contact plate remaining in abutting contact with said first contact plate, thereby causing a change in position of said movable arm, the distance between its bearing point and the counter contact increasing, until said elongated movable contact hits said first stop means which stops its rotation in said one direction and causes said elongated movable contact to rotate in a second, opposite direction, resulting in its second contact plate being instantaneously separated from the first contact plate of said elongated counter contact.

2. An electric switch according to claim 1, including a spring mechanism for biasing said movable arm by a torsional moment which changes direction at an intermediate position of the arm.

3. An electric switch according to claim 1, including a second stop means and a spring for holding, during normal operation, the second end of the elongated movable contact against said second stop means.

4. An electric switch according to claim 1, including a movable contact carrier, and wherein said movable arm is journalled on said movable contact carrier.

5. An electric switch according to claim 1, including a contact carrier having a bearing therein, and wherein said movable arm consists of at least one substantially U-shaped plate spring having two leg ends, one leg end being rotatably journalled in said contact carrier and the other leg end being articulately connected to a supporting leg which, under pressure from the plate spring, is rotatable between two end positions in said bearing in said contact carrier.

6. An electric switch according to claim 5, wherein each said plate spring includes a hole, wherein said elongated movable contact carrier includes a hole which is aligned with the holes in said plate springs, and wherein said electric switch includes a second stop means and a pressure spring is located in said holes, said pressure spring being arranged to influence the elongated movable contact by a torque which during normal operation holds the second end thereof pressed against said second stop means.

7. An electric switch according to claim 6, wherein said first and second stop means are arranged on said contact carrier.

8. An electric switch according to claim 1, including a first U-shaped soft iron magnet which is arranged in such a way that part of the cross-section of the elongated movable contact lies between the two legs of said first magnet.

9. An electric switch according to claim 8, including a second U-shaped soft iron magnet which is fixedly arranged between the second end and the bearing point of said elongated movable contact in such a way that both of the elongated counter contact and the elongated movable contact pass between the legs of said second magnet with the counter contact positioned nearest the yoke of the magnet.

10. An electric switch according to claim 9, wherein said second magnet forms an air gap for said elongated movable contact, said air gap tapering towards the second end of said elongated movable contact.

11. An electric switch according to claim 1, including a U-shaped soft iron magnet having a yoke and two legs fixedly positioned between the second end of said elongated movable contact and said bearing point such that said counter contact extends therethrough near said yoke and said elongated movable contact extends therethrough between said two legs.

* * * * *